United States Patent [19]

Weskamp et al.

[11] 4,093,758

[45] June 6, 1978

[54] ARTIFICIAL CHRISTMAS TREE WITH FOLDABLE BRANCHING AND METHOD OF MAKING SAME

[75] Inventors: Robert J. Weskamp, Prospect Heights; Robert H. Barclay, Monee, both of Ill.

[73] Assignee: Industrial Park Machine & Tool Co, Inc., South Chicago Heights, Ill.

[21] Appl. No.: 801,652

[22] Filed: May 31, 1977

Related U.S. Application Data

[63] Continuation of Ser. No. 631,446, Nov. 13, 1975, abandoned.

[51] Int. Cl.[2] ..... A47G 33/06

[52] U.S. Cl. ..... 428/8; 428/9; 428/20

[58] Field of Search ..... 428/7, 8, 9, 12, 15, 428/17–20

[56] References Cited

U.S. PATENT DOCUMENTS

| | | | |
|---|---|---|---|
| 1,683,637 | 9/1928 | Trimpe | 428/8 |
| 2,708,324 | 5/1955 | Wedden | 428/12 X |
| 2,742,327 | 4/1956 | Marks | 428/15 X |
| 3,030,720 | 4/1962 | Osswald et al. | 428/8 |
| 3,210,820 | 10/1965 | Humiston | 24/214 X |
| 3,469,290 | 9/1969 | Andrews | 24/208 A |
| 3,499,818 | 3/1970 | Kent | 428/18 |
| 3,574,102 | 4/1971 | Hermanson | 428/20 X |
| 3,616,102 | 10/1971 | Baus et al. | 428/20 |
| 3,639,196 | 2/1972 | Hermanson | 428/20 X |

*Primary Examiner*—George F. Lesmes
*Assistant Examiner*—Henry F. Epstein
*Attorney, Agent, or Firm*—Hubbell, Cohen, Stiefel & Gross

[57] ABSTRACT

Artificial Christmas tree, including a trunk with a plurality of transversely extending axially spaced holes. A pivotal mounting member, preferably U-shaped, is press fitted into each hole with a front end portion of each extending outwardly from the trunk. A branch is pivoted on each member by means of a securing element extending between the legs of the U-shaped front end portion, about each extends an arcuately formed end portion of the branch.

3 Claims, 16 Drawing Figures

ARTIFICIAL CHRISTMAS TREE WITH FOLDABLE BRANCHING AND METHOD OF MAKING SAME

This is a continuation, division, of application Ser. No. 631,446, filed Nov. 13, 1975, now abandoned.

BACKGROUND OF THE INVENTION

1. Field of the Invention

This invention relates to artificial Christmas trees, and particularly, to artificial Christmas trees having foldable branches to facilitate the storage thereof.

2. The Prior Art

Artificial Christmas trees have been known for many years. To reduce the storage volume of such trees, it has been also known for many years to removably mount the branches on the trunk of the artificial tree by plugging the branches into complementary holes in the trunk. While this arrangement does permit the storage of an artificial tree in a relatively small space, the process of assembling the tree and, to a lesser extent, of disassembling the tree are quite time consuming. Thus, it has been suggested in the past of color code the holes in the tree trunks and the ends of the branches, whereby to readily arrange the branches on the trunk. This has reduced the assembly time, but it is still relatively time consuming.

It has also been suggested for many years to pivotally mount branches on a trunk whereby to permit the branches to be swung from a folded position in which they are substantially parallel to the trunk to an extended position in which they extend outwardly from the trunk to define a simulated or artificial tree. Such a structure was suggested in U.S. Pat. No. 1,683,637 granted to E. H. Trimpe on Sept. 11, 1928 and in U.S. Pat. No. 3,030,720 granted to Osswald et al on Apr. 24, 1962. However, both of these patents require elaborate assembly techniques, and, in the case of the Oswald et al patent, a somewhat complex structure, whereby to render both of these prior art patents of little importance in commercial development of artificial Christmas trees.

More recently, U.S. Pat. Nos. 3,574,102 and 3,639,196 have been granted to T. Hermanson, which have disclosed an artificial Christmas tree with foldable branches. The structure described in the two Hermanson patents require some form of bifurcation at the ends of the branches in order to enable the branches to be pivotally mounted on the trunk, which bifurcation requires special tooling not heretobefore employed in the making of artificial Christmas trees.

DETAILED DESCRIPTION OF THE PREFERRED EMBODIMENT

Figure 1:
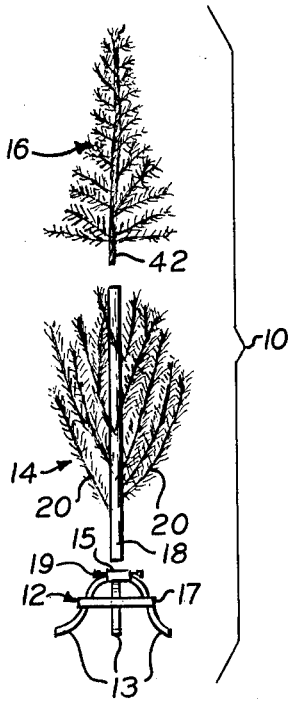
FIG. 1 is an exploded side elevational view of an artificial Christmas tree embodying the present invention.

Referring now to the drawings in detail, an artificial Christmas tree embodying the present invention is generally designated by the reference character 10. The tree comprises a stand 12, a base 14 and a top 16. The stand 12 may be of any suitable construction and forms no part of the invention per se. Suffice it to say, it should be relatively rugged and stable and easily connected to the balance of the tree 10. As shown herein in FIGS. 1 and 2, the base 12 is a tripod structure having three legs 13 joined by a connecting ring 15 and a retaining disc 17. The connecting ring 15 has a central opening (not seen) through which the trunk 18 of the base 14 may fit. The trunk may be firmly joined to the base by means of adjustable screws 19.

Figure 3:
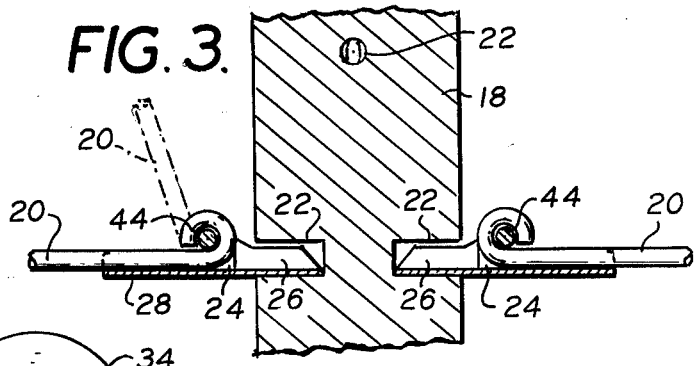
FIG. 3 is a fragmentary vertical sectional view through the trunk of the tree.
Figure 4:
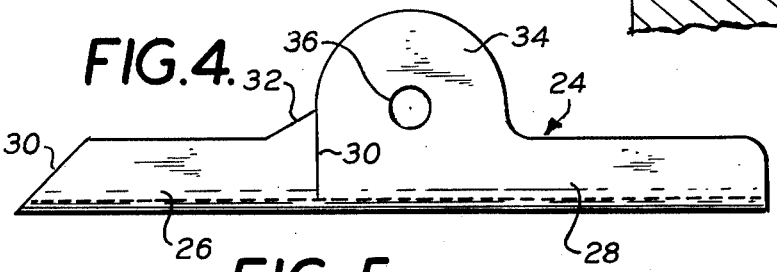
FIG. 4 is a side elevational view of a pivotal mounting for a branch for the tree of FIGS. 1 and 2.
Figure 5:
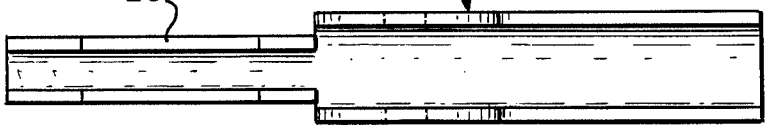
FIG. 5 is a top elevational view of said pivotal mounting.
Figure 6:
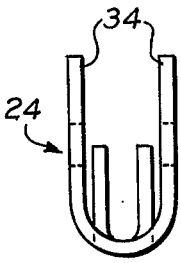
FIG. 6 is a front elevational view of said pivotal mounting.

As already noted, the base 14 is provided with a central vertically extending trunk 18 from which extend a plurality of branches 20, which branches are pivotally mounted on the trunk 18 by pivotal mounting means forming the present invention. Specifically, with reference especially to FIG. 3, the trunk 18 is provided with a plurality of blind holes 22 which are longitudinally and circumferentially distributed about the surface of the trunk 18 to provide attachment means for securing the branches 20 to distributed points along the surface of the trunk 18 so as to extend away from said trunk in the manner of a natural Christmas tree. Although not preferred, the apertures 22 may be the end portions of a single through hole without departing from this invention Secured in each hole 22 is a pivotal mounting member 24, one form of which is illustrated in FIGS. 4 through 6. Specifically, each of the members 24 is preferably generally U-shaped and has a rear portion 26 thereof force fitted into a hole 22 for fixedly securing the member 24 to the trunk 18. In the embodiment of FIGS. 4 to 6, the end 26 which will hereinafter be referred to as the rear end of the member 24 is bent into a U-shape wherein the legs of the "U" are relatively close as compared with the legs of the U-shaped front end 28. This can be accomplished by providing a transverse slit 30 on each leg between the front and rear portion 28 and 26 respectively, which slits extend to but not through the bight of the "U". Thus, when the member 24 is bent into its U-shape from its initial flat shape in which it comes from a stamping machine or the like, the rear and front portions can be bent separately while remaining integral along the bits of the "U".

In order to assure a firm mounting of the member 24 in its aperture or hole 22, at least one dimension of the rear end portion 26 must be of sufficient dimensional extent to require and to be able to be force fitted into the hole. In the embodiment shown in FIGS. 4 to 6, that dimension is the length of the leg of the "U" of rear end portion 26.

To facilitate insertion of the rear end 26 into the blind hole 22 and to enhance the security of the connection therebetween, the rear end surfaces 30 of the legs of the U-shaped rear portion 26 are preferably upwardly sloping so that they may penetrate the blind ends of the holes 22 a short distance for good securement. Additionally, if desired, the front ends of the legs of the U-shaped rear end portion 26 may also be forwardly upwardly sloped as at 32 whereby to provide for a wedging action when the rear end 26 is forced into the blind holes 22.

The front end 28 of the pivotal mounting member 24 is provided with a pair of ears 34 at the rear end thereof, which ears will be located closely adjacent the surface of the trunk 18 when the mounting members 24 are properly inserted. The ears 34 are provided with through holes 36 which are in register with one another for reasons which will become apparent hereinafter. The remainder of the front end portion 28 is of lesser vertical extent than the ears 34, but is nevertheless preferably U-shaped.

As already suggested, the member 24 can be made initially by stamping the member from a flat plate of sheet metal and thereafter bending it into the described shape. All of this could, of course, be automated by metal working equipment well known to those skilled in that art.

To form the lower portion or base 14 of the tree 10, pivotal mounting members 24 are driven into each blind hole 22 in the trunk 18. This may be done manually as by hammer or the like, or a suitable machine such as a "gun" can be fashioned for automatically "shooting" each of the members 24 into its associated hole 22. However, the insertion of the member 24 into the hole 22, whether it be accomplished manually or by some automatic device, should be sufficient to cause the pointed rear end of the rear end portion 26 to bite into the blind end of the hole 22 with the upwardly sloping front end surface 32 wedging into the front end portion of the blind hole 22 to effect a secure connection between the member 24 and the trunk 18. Clearly, the front end portion 28 of member 24 will extend outwardly from the trunk 18 a short distance of the order of magnitude of about an inch and one-half, by way of example and not by way of limitation. As will be more fully understood, the front end portion will act as a rest or abutment for the end of the branch mounted on the member 24 when that branch is positioned for use.

Figure 7:
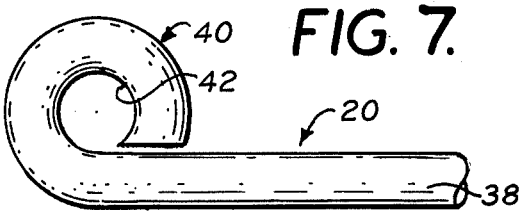
FIG. 7 is a fragmentary view showing the end of a pivotal branch for the tree of FIGS. 1 an 2.

Referring now to FIG. 7, the rear looped end 40 of a branch 20 is shown. Branch 20 may be of any suitable type of artificial branch. Preferably, however, the branch 20 has a central limb member in the form of twisted wires from which extend a multiplicity of artificial needles which are permanently held between the wires of the limb member as by twisting. Such a branch may be made in accordance with U.S. Pat. No. 2,742,327, the contents of which are hereby incorporated by reference. Preferably, although not necessarily, the branches 20 may be furcated at their outer ends to form twigs. The twigs may be affixed to the branch in any suitable fashion, such as, for example, in accordance with the description of U.S. Pat. No. 3,499,818, the contents of which are hereby incorporated by reference. As already noted, the limb of a branch 20 is formed of twisted wires. The rear or inner end of such a branch is shown in FIG. 7 with the rear most portion bent to form a loop 40 that is disposable between the ears 34 of the front end portion 28 of the connecting member 24. The central aperture 42 of the looped end 40 of the branch 20 is registrable with the registered apertures 36 in the ears 34 of the member 24. When so registered, a suitable securing element such as, for example, a rivet 44 (see FIG. 3) may be inserted through the registered apertures 36 and the aperture 42 and secured in such position to act as a pivot for the branch 20. The branch so constructed is clearly pivotally movable between a lowermost position, essentially horizontal in FIG. 3, in which the rear end 38 rests against the front end portion 28 of the connecting member 24 and to and from a substantially vertical position shown in dotted line in FIG. 3. Thus, the trunk 18 can be assembled with a multiplicity of branches 20, all connected by connecting members 24 so that the branches may be swung upwardly to a vertical position where they lie closely against the trunk 18 and are thus relatively compact and to a horizontal position for use as a simulated Christmas tree. This enables compact storage of the trunk 18 with its branches connected thereto and for very rapid unfolding of those branches for use when desired.

Figure 15:
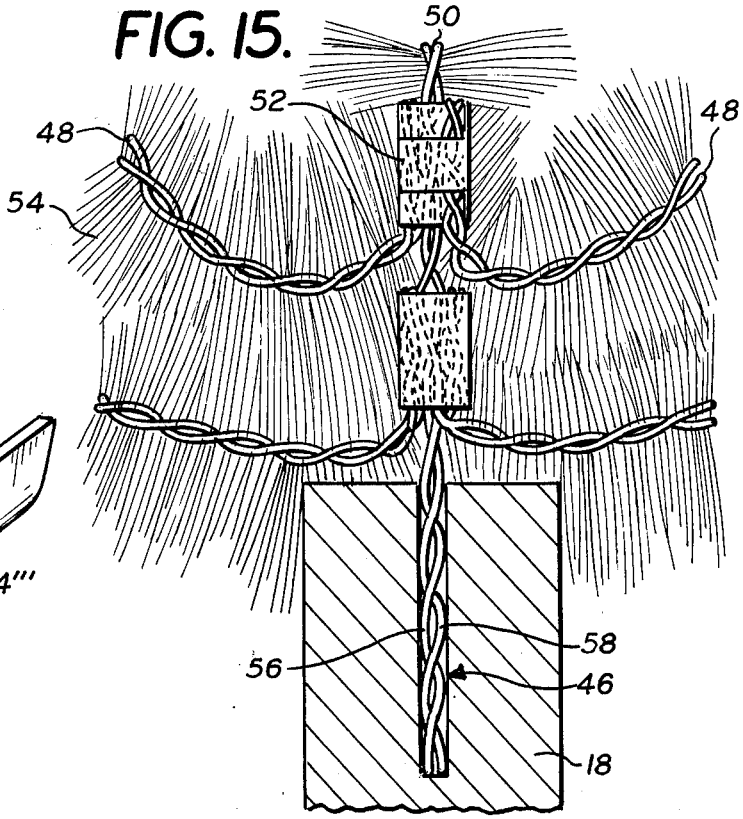
FIG. 15 is a vertical sectional view illustrating a connection between the upper end of the tree trunk and the top section of the tree.

While the pivotal mounting of the branches 20 on the trunk 18 of the base section 14 is desirable, it is deemed unnecessary for the upper portion thereof, which upper portion does not occupy a large volume even in use and thus may be permanently arranged with its branches in an outwardly extending condition. Thus, the upper portion 16 of the tree 10 may be permanently constructed with an axial trunklike member 46 and a multiplicity of branches 48 permanently affixed thereto and extending outwardly therefrom. The trunk 46 of upper portion 16 may be constructed similarly to the trunk 18. However, it is presently preferred that the trunk 46 of the upper portion 16 be constructed of heavy gauged twisted wires 50 and that branches 48 of the upper portion be permanently secured thereto as by clips 52 encircling the entrapped ends of the branches 48 and a portion of the twisted wire trunk 46 (see FIG. 15). Naturally, the branches 48 are preferably also made of twisted wires with needles 54 entrapped between them in the same manner as the construction of the lower branches 20. As an alternative, the branches 48 of the upper portion may be secured to trunk 30 by twisting the branches about the trunk.

The upper portion 16 may thus be connected to the base 14 of the tree 10 as a single finally shaped unit. While the manner of connecting upper portion 16 to base 14 may be in accordance with any desired construction, it is presently preferred that a pair of axially extending apertures 56 be provided at the upper end of the trunk 18, the apertures being proportioned to receive with relatively close tolerance the lower end portions 58 of the wires forming trunk 46 of the upper section 16. Thus, to assemble the upper portion 16 with the base 14, all that need be done is to insert the lower end portions 58 of the upper trunk wires into the axially extending apertures 56 at the upper end of the trunk 18.

Figure 8:
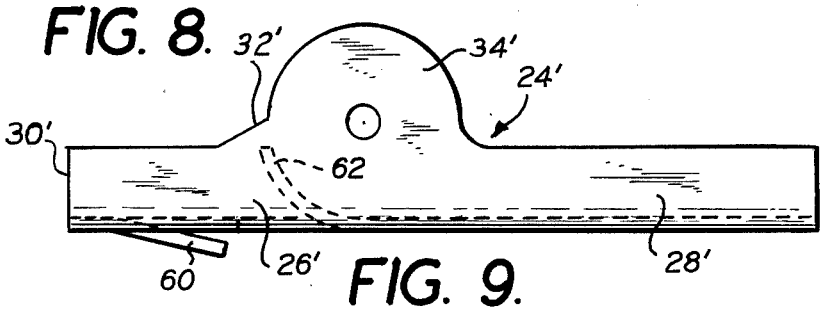
FIG. 8 is a side elevational view of a modified form of a pivotal mounting.
Figure 10:
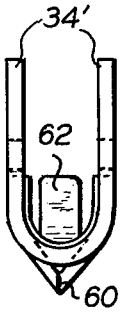
FIG. 10 is a front elevational view of the front elevational view of the mounting of FIG. 8.
Figure 9:
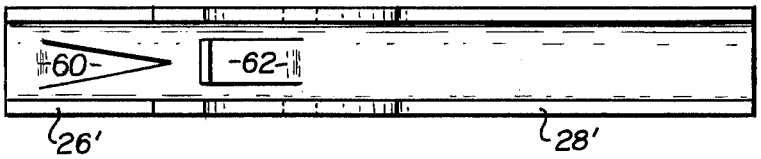
FIG. 9 is a top plan view of the mounting of FIG. 8.

Other forms of pivotal connecting members may be employed without departing from the present invention. Thus, with reference to FIGS. 8 through 10, a connecting member 24' is illustrated that is generally similar to the connecting member 24 of FIGS. 4 through 6. That is to say, the connecting member 24' is generally U-shaped with a rear end portion 26' and a front end portion 28' here shown to be in the same U-shaped configuration rather than the rear being of a smaller or narrower "U" as was true in the embodiment of FIGS. 4 to 6. Also, the rear end edge 32' is shown to be vertical and not upwardly sloping as is true of the surface 30 in the FIG. 4 to 6 embodiment. However, if desired, the surface 30' could be upwardly sloping rather than vertical. The two major differences between connecting member 24' and connecting member 24 is the provision of a downstruck portion 60 in the bight of the "U" of the rear shaped portion 26' which downstruck portion serves as a barb to positively prevent removal of the connecting member 24' from a hole 22 once the member is fully inserted. Moreover, in the connecting member 24', an upstruck portion 62 in the bight of the "U" adjacent the ears 34' is provided which serves as an arcuate bearing surface for the looped end 40 of the end 38 of a branch 20. Clearly, the connecting member 24' can be driven into a hole 22 by a hammer or a suitable mechanical gun and once driven in the barb will effectively prevent removal thereof.

Figure 11:
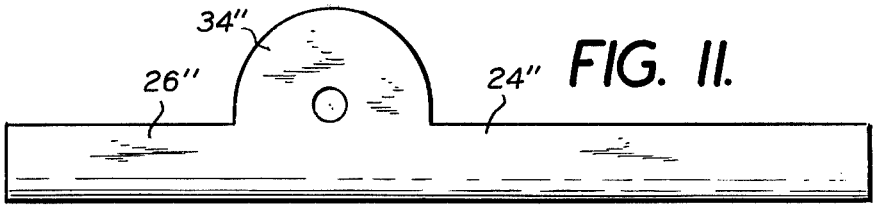
FIG. 11 is a side elevational view of yet another form of mounting embodying the present invention.
Figure 13:
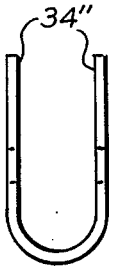
FIG. 13 is a front elevational view of the mounting of FIG. 11.
Figure 12:
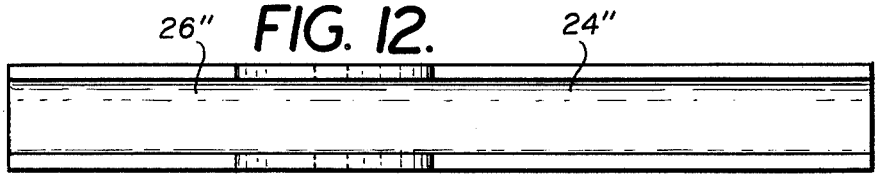
FIG. 12 is a top elevational view of the mounting of FIG. 11.

Referring now to FIGS. 11 through 13, a still further modified form of connector members designated by the reference numeral 24'' is shown which is in all respects identical to the member 24' save that there is no downstruck portion 16 or upstruck portion 62. This member relies wholly on the friction of a pressed fit of the rear end portion 26'' to hold the member 24'' in the blind hole 22.

Figure 14:
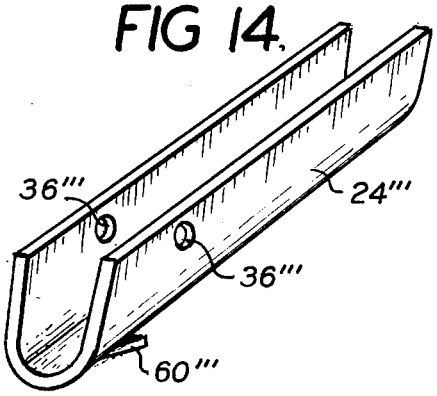
FIG. 14 is a perspective view of yet another form of mounting embodying the present invention.

Referring now to FIG. 14, yet another modification of the invention is shown. In FIG. 14, the connector element is designated character 24''' and is a simple U-shaped member with a pair of registered apertures 36''' in the leg of the U-shaped member at some point intermediate the two ends of the member. Preferably, although not necessarily, a downstruck portion 60''' in a V-shaped form is provided to serve as a barb for preventing withdrawal of the member. Clearly, in the embodiment of FIG. 14, the entire member is configured for press fitting into a blind hole 22.

It will be obvious that with respect to each of the embodiment 24', 24'' and 24''' hereinbefore described, that the branch 20 can be mounted in the same manner as it is mounted on the connecting member 24 of FIGS. 4 to 6. That is to say, the looped end 40 is disposed within the member so that the aperture 42 defined by the loop end 40 registers with the holes 36', 36'' or 36''' and when so registered a suitable securing element such as a rivet, a screw or the like is inserted through the registered hole to provide a pivot for the branch. In all embodiments, it will be obvious that the branch is pivotal between a horizontal position limited by the front end of the pivotal connecting member 24, 24', 24'' or 24''' and a substantially vertical position for storage While the preferred shape of both the front and rear portion is a U-shape, it will be apparent that other cross-sectional shapes may be employed for both portions. The rear portion may be of any cross-section that will yield a press fit with holes 22; the front portion should have a lower element extending forwardly of and below the pivot to serve as a stop for the branch. The U-shape is preferred for the rear portion as it provides some flex to render a tight fit. The stop function automatically is provided by the bight of the "U". Moreover, the overall U-shaped form renders the pivotal mounting member readily formable from sheet metal by first stamping and then bending the piece.

Figure 16:
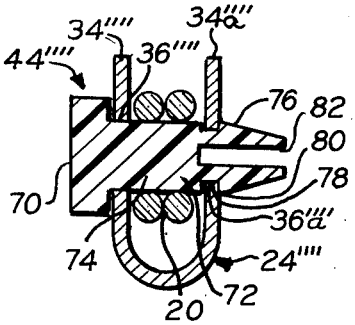
FIG. 16 is a transverse sectional view of a pivotal mounting member with a branch pivotally mounted thereon.

Referring now to FIG. 16, the presently preferred form of pivot member 44 designated by the reference numeral 44'''' is shown in combination with the now presently preferred embodiment of pivotal connecting member 24''''. This connecting member 24'''' is generally the same as the connecting member 24' shown in FIGS. 8 and 9, excepting that the downstruck portion 60 and the upstruck portion 62 of the FIG. 8 and 9 embodiment is deleted and the apertures 36' are of different diameter for reasons which will become apparent hereinafter. Accordingly, a detailed description of the connecting member 24'''' is deemed unnecessary.

The pivot member 44''' which may be used with any of the forms of connecting members 24 previously described is a member having a head 70 and a shank 72. The shank is divided into two portions, a head end portion 74 adjacent said head 70 and a tail end portion 76 which is tapered. The aperture 36'''' in the ear 34'''' adjacent the head 70 is of a diameter larger than the diameter of the head end portion 74 of the shank 72, whereby to permit passage of the shank therethrough. The aperture **36*a*'''' in the ear 34*a*'''' remote from the head 70 is of somewhat smaller diameter than the head end portion of the shank so as to prevent its passage therethrough. Provided in the shank 72 in the zone of meeting of the head end portion and the tail end portion thereof is a circumferential groove 78 which is preferably somewhat smaller in diameter than the aperture 36*a*''''. However, the edge of the groove defined by the tail end portion, that is the edge 80, is of larger diameter than the aperture 36*a*''''**.

To mount the branch 20 on the connecting member 24'''', the looped end thereof is positioned so that the central aperture defined by the looped end registers with the apertures 36'''' and **36*a*''''. The shank of the securing element is then aligned with the registered apertures on the side of the connecting member adjacent the ear 34''''. It is then inserted through the aperture 36'''' and through the aperture defined by the looped end of the branch 20 and thence to the aperture 36*a*'''' where it will bear against said aperture because it is of greater diameter than said aperture. At that point, longitudinal thrust applied to head 70 will force the tail end 76 to move against the wall of the aperture 36*a*'''' which will deflect or compress the tail end, which compression is permitted by a slot 82. Further longitudinal movement will continue until the groove 78 straddles the ear 34*a*'''' at which point the tail end will snap out to thereby seat the ear 34*a*'''' in the groove 78 of the shank 72** to hold the securing element in the illustrated position.

Clearly, the width of the slot 82 must be sufficient to permit enough deflection or compression of the tail end so that that end may clear the aperture **36*a*''''. Thus, the slot width is a function of the diameter of the aperture 36*a*'''' and of the tail end edge of the groove and is readily determinable by anyone skilled in the art. It will also be obvious from a persual of FIG. 16 that the length of the shank between the head 70 and the head end edge of the groove 78 must be somewhat larger than the distance between the outer surface of the ear 34'''' and the inner surface of the ear 34*a*'''' in order to permit the groove to become aligned with the ear 34a''''. Preferably, it is only slightly longer than said distance. It will further be obvious that the width of the groove 78 must be at least slightly larger than the thickness of the ear 34a''''. Moreover, it is preferred that the diameter of the groove 78 be less than the diameter of aperture 36a''''** although this is not absolutely necessary so long as the shank can be compressed to yield a groove of such diameter.

Clearly, at least the tail end portion of the securing element 44'''' must be elastically deformable. Preferably, the entire securing element is a unitary member made of elastically deformable material, such as, for example, steel or a wide number of plastics, for example, polystyrene, polypropylene or any of a myriad of well known materials. Most preferably, the elastically deformable plastic materials should be injection moldable whereby to permit the injection molding of the unitary securing element 44''''.

Figure 2:
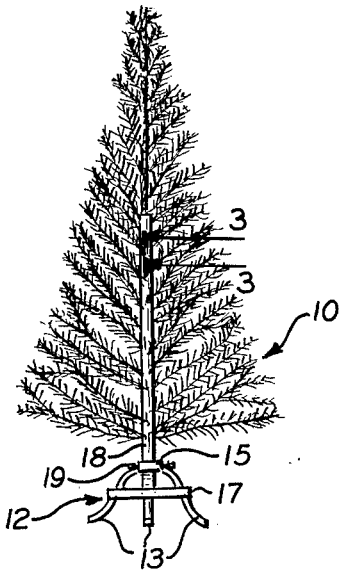
FIG. 2 is a side elevational view of the tree of FIG. 1, but in assembled condition.

Irrespective of the form of connecting member employed, the tree 10 is generally stored in a box or similar container in a disassembled condition with the branches 20 of the base 14 folded to be essentially parallel to the trunk 18. To assemble the tree for use, as at the Christmas season, the three parts 12, 14 and 16 are removed from the box, the stand 12 is placed on the floor or table or the like, and the lower portion of base 14 is brought into operative relation with the stand by putting the lower end of the trunk 18 through the center of the connecting ring 15. Thereupon, the screws 19 are turned to tighten them to thereby fix the base to the stand. The branches 20 may then be pivoted outwardly from their vertically extending positions as shown in dot-dash lines in FIG. 3 to their angular positions as shown in solid lines in FIG. 3 which angular positions are defined by the relationship between the end portions 28 of the limbs and the balance thereof. After the lower branches 20 are moved to their outstanding position, the top 16 may be connected to the upper end of the base 14 as by inserting the bottom 42 of upper trunk member 30 into the aperture 56 in lower trunk 18. Assuming the tree has been properly fabricated and there has been no damage to the lower branches 20, the tree will quickly assume the conical configuration as shown in FIG. 2. In the event that there has been some damage to the tree, a very easy bending of the branches 20 and 48 can be performed to shape the branches and hence the tree to the desired configuration as shown in FIG. 2.

While I have herein shown the described and preferred form of the present invention and have suggested modifications therein, other changes and modifications may be made therein within the scope of the appended claims without departing from the spirit and scope of this invention.

I claim:

1. In an artificial Christmas tree of the type including a central trunk and a plurality of branches pivotally movable to and from positions outstanding from said trunk and from and to positions substantially co-axial with said trunk, the improvement comprising an improved means for pivotally mounting at least one of said branches on said trunk, said improved means comprising:

the provision of a hole in said trunk;

a pivotal mounting member having a rear end portion press fitted into said hole, a front end portion extending outwardly from said trunk and a pivot member mounted on said front end portion rearwardly of the front end thereof; said front end portion of said pivot mounting being U-shaped, said pivot member extending between the legs of said U in spaced relation with the bight thereof, said one branch having its rear end pivotally mounted about said pivot member whereby, when said branch is pivotally moved to its outstanding position, it engages the front end of said front end portion to be held thereby in said outstanding position;

said U-shaped front end portion having a pair of aligned apertures for mounting said pivot member, one of said apertures having a larger diameter than the other, and said pivot member being formed of elastically deformable material and comprising a head having a diameter larger than said one aperture, a shank having a head end portion of diameter smaller than said one aperture and larger than the other and a tapered tail end portion, said shank further including a circumferential groove at the junction of said head and tail end portions of width greater than the length of said other aperture wherein said pivot member is an integral member injection molded from plastic, the edge of said groove on the tail end portion having a diameter greater than the diameter of said other aperture, said shank further having a slot extending across said shank from the tail end thereof to at least the plane of the edge of said groove on the head end portion of said shank, said slot being of sufficient width to permit inward flexing of said tapered end of said shank so that it can clear said other aperture when forced therethrough, whereby when said pivot member is moved longitudinally through said one aperture the tail end portion can be forced through said other aperture until said groove registers therewith, whereupon said tail end portion will elastically expand to dispose the portion of said leg surrounding said other aperture into said groove to hold said pivot member in said position.

2. In an artificial Christmas tree of the type including a central branch trunk and a plurality of branches pivotally movable to and from positions outstanding from said trunk and from and to positions substantially coaxial with said trunk, the improvement comprising an improved means for pivotally mounting at least one of said branches on said trunk, said improved means comprising:

the provision of a hole in said trunk;

a pivotal mounting member having a rear end portion press fitted into said hole, a front end portion extending outwardly from said trunk and a pivot member mounted on said front end portion rearwardly of the front end thereof, said pivot mounting member being U-shaped along its entire length and having a front end portion wherein each of the legs thereof include an upstanding ear, said ears being provided with mutually registered apertures, said pivot member being a securing element secured to said mounting member by extending through said registered ear apertures;

the rearmost edge portion of said ears sloping downwardly towards the rear end of said pivot mounting member at an angle substantially less than 90°, the rearmost edge of said rear end portion of said pivotal mounting member being at an angle to the vertical;

one of said registered ear apertures having a larger diameter than the other, and said securing element being formed of elastically deformable material and comprising a head having a diameter larger than said one aperture, a shank having a head end portion of diameter smaller than said one aperture and larger than the other and a tapered tail end portion, said shank further including a circumferential groove at the junction of said head and tail end portions of width greater than the length of said other aperture wherein said pivot member is an integral member injection molded from plastic, the edge of said groove on the tail end portion having a diameter greater than the diameter of said other aperture, said shank further having a slot extending across said shank from the tail end thereof to at least the plane of the edge of said groove on the head end portion of said shank, said slot, being of sufficient width to permit inward flexing of said tapered end of said shank so that it can clear said other aperture when forced therethrough, whereby when said pivot member is moved longitudinally through said one aperture the tail end portion can be forced through said other aperture until said groove registers therewith, whereupon the tail end portion will elastically expand to dispose the portion of said leg surrounding said other aperture into said groove to hold said pivot member in said position;

said one branch having its rear end pivotally mounted about said securing element whereby when said branch is pivotally moved to its outstanding position, it engages the front end of said front end portion to be held thereby in said outstanding position.

3. In an artificial Christmas tree of the type including a central trunk and a plurality of branches pivotally movable to and from positions outstanding from said trunk and from and to positions substantially co-axial with said trunk, the improvement comprising an improved means for pivotally mounting at least one of said branches on said trunk, said improved means comprising:

a pivotal mounting member, means for connecting said pivotal mounting member to said trunk with the front end portion extending outwardly from said trunk, a pivot member mounted on said front end portion rearwardly of the front end thereof; said front end portion of said pivot mounting being U-shaped, said pivot member extending between the legs of said U in spaced relation with the bight thereof, said one branch having its rear end pivotally mounted about said pivot member whereby, when said branch is pivotally moved to its outstanding position, it engages the front end of said front end portion to be held thereby in said outstanding position;

said U-shaped front end portion having a pair of aligned apertures for mounting said pivot member, one of said apertures having a larger diameter than the other, and said pivot member being formed of elastically deformable material and comprising a head having a diameter larger than said one aperture, a shank having a head end portion of diameter smaller than said one aperture and larger than the other and a tapered tail end portion, said shank further including a circumferential groove at the junction of said head and tail end portions of width greater than the length of said other aperture wherein said pivot member is an integral member injection molded from plastic, the edge of said groove on the tail end portion having a diameter greater than the diameter of said other aperture, said shank further having a slot extending across said shank from the tail end thereof to at least the plane of the edge of said groove on the head end portion of said shank, said slot being of sufficient width to permit inward flexing of said shank so that it can clear said other aperture when forced therethrough, whereby when said pivot member is moved longitudinally through said one aperture the tail end portion can be forced through said other aperture until said groove registers therewith, whereupon said tail end portion will elastically expand to dispose the portion of said leg surrounding said other aperture into said groove to hold said pivot member in said position.

* * * * *